United States Patent [19]

Meredith

[11] 4,330,129

[45] May 18, 1982

[54] LIGHT DUTY TARGET SUPPORT APPARATUS

[75] Inventor: Brian H. Meredith, Leafield, England

[73] Assignee: Australasian Training Aids (Pty.) Ltd., Albury, Australia

[21] Appl. No.: 190,809

[22] Filed: Sep. 25, 1980

[51] Int. Cl.[3] ..... F41J 1/10; F41J 1/20

[52] U.S. Cl. ..... 273/372; 273/406; 273/407; 248/188.6

[58] Field of Search ..... 273/406, 407; 248/166, 248/188.6

[56] References Cited

U.S. PATENT DOCUMENTS

| | | | |
|---|---|---|---|
| 255,215 | 3/1882 | Tuttle | 248/166 X |
| 1,761,039 | 6/1930 | Hazeltine | 273/176 H |
| 4,119,317 | 10/1978 | Ohlund et al. | 273/406 |
| 4,157,798 | 6/1979 | Lin | 248/166 X |

*Primary Examiner*—George J. Marlo

*Attorney, Agent, or Firm*—Schwartz, Jeffery, Schwaab, Mack, Blumenthal & Koch

[57] ABSTRACT

A lightweight, portable apparatus which is foldable for storage and stackable when folded, and deployable to provide stable support for a planar target member for target shooting purposes. The apparatus has a generally box-like main frame of tubular members, including skid rails extending longitudinally of the main frame, upper longitudinal rails generally parallel to the main frame skid rails, upright members connecting the main frame skid rails and the upper longitudinal rails at least at the forward and rear ends of the main frame, and lower cross-bars extending transversely to and interconnecting the main frame skid rails. The apparatus also includes a stabilizer frame having a pair of stabilizer skid rails spaced apart a distance greater than the width of the main frame and having a length approximately equal to the length of the main frame skid rails, a plurality of cross-bars interconnecting the stabilizer skid rails, and at least one upright member extending upwardly from each stabilizer skid rail at a forward end of the stabilizer frame. The stabilizer frame upright members are pivotably connected to respective upright members at the rear end of the main frame. When the planar target is removed, the apparatus may be folded for storage by pivoting the stabilizer frame upwardly until the stabilizer frame cross-bars rest across the upper longitudinal rails of the main frame. One folded apparatus may be stacked on top of another, with the main frame skid rails of the upper apparatus nested between the stabilizer skid rails of the lower apparatus.

16 Claims, 5 Drawing Figures

LIGHT DUTY TARGET SUPPORT APPARATUS

BACKGROUND OF THE INVENTION

1. Field of the Invention

The invention relates to devices for supporting planar targets for use in target shooting, particularly tank targets for use in anti-tank weapon training and the like.

2. The Prior Art

A number of target devices are known in the art for training marksmen in the use of rifles and like weapons. For example, U.S. Pat. No. 3,233,904 to GILLAM et al discloses an automatic electrical target apparatus for supporting a planar target; the target is exposed for target shooting when in a vertical position, and is caused to "disappear" or drop to a horizontal position when a hit is scored upon the target or after a predetermined period if it is not hit during that period. U.S. Pat. No. 3,233,904 discloses a target-operating mechanism and control circuit arrangement for performing these and other functions, and the disclosure of such patent is incorporated herein by reference.

Other controlling apparatus for such targets is disclosed in U.S. Pat. No. 3,323,800 to L. C. KNIGHT, and the disclosure of such patent is also incorporated herein by reference.

Another type of target supporting apparatus is disclosed in U.S. Pat. No. 3,865,373, the apparatus comprising a trolley movably mounted on a track and having a target mechanism for moving the target between an operative shooting position where the target is visible at a firing point and an inoperative position where the target is invisible from the firing point.

Also known in the prior art is a portable version of the target apparatus similar to that shown in U.S. Pat. No. 3,233,904, wherein the target-operating mechanism is contained in a housing and provided with a source of power, such as a battery, the power source and housing being situated within a generally box-like frame having a generally rectangular base, upright members extending upwardly from the corners of the base, and a generally rectangular upper framework connected to the uprights. Extending upward from the housing is a bracket for receiving a relatively small ("standing man-size") target. The target is removable from the bracket, so that the devices may be stacked for transport and storage. While such an apparatus is quite adequate for relatively small targets (for example, planar targets of approximately one-half meter width and one meter height), such small and lightweight target mechanisms with relatively small frameworks are not sufficient for target shooting with anti-tank weapons or other large-caliber ammunition. For training with anti-tank weapons or other large-caliber weapons, it is conventional to use a relatively large target of, for example, about 2.4 meters width and 1.5 meters height to simulate a tank or other vehicle. Such large target surfaces are subject to considerable wind forces on windy days and to substantial impact forces when hit by a large-caliber round. Accordingly, for training with large-caliber ammunition, it is necessary to provide a target support which is stable enough to withstand such forces.

A number of target support arrangements are known for full-size tank targets. One such arrangement is mounted on a trolley which rides on a fixed-rail installation, the target and trolley being movable along the rail to simulate a moving target. Another type of full-size tank target support mechanism is known which has a crankshaft approximately as long as the target is wide, with the target being supported on the crankshaft by a number of support arms spaced therealong. The crankshaft is journaled in a number of bearing blocks, typically three such blocks, and is coupled to a drive mechanism which rotates the crankshaft to raise the target to a vertical position for shooting and lower the target to a horizontal position when hit. The bearing blocks are bolted to a rigid base such as, for example, concrete pilings in the ground which provide significant stability; a disadvantage with such an arrangement is that it is not easily transported from one location to another and substantial time is required for dismantling and reassembly of the apparatus when the target is to be relocated.

Target devices of the aforementioned types are available from Australasian Training Aids Proprietary, Limited of Albury, Australia.

Still another target mechanism is known from Australian patent Specification No. 501,547 to SAAB-Scania AB, filed Mar. 23, 1977. Such device does not fold for stacking and storage, although it is provided with runners along its bottom and is intended to be portable.

SUMMARY OF THE INVENTION

It is accordingly an object of the present invention to provide a target support apparatus for a planar full-size tank target, the apparatus being sufficiently stable to support such an apparatus against forces of wind and impacting large-caliber rounds, while at the same time being easily portable.

In accordance with the invention, a target support apparatus is provided which comprises a generally box-like main frame of tubular members, pivotably connected at its rear end to a stabilizer frame. The stabilizer frame may be rotated to a position where it lies on top of and partially surrounding the main frame, for storage and easy transportation of the apparatus. When the stabilizer frame is rotated to a position wherein it extends rearwardly from the rear end of the main frame, a stable base is provided for supporting the target.

The generally box-like main frame preferably has skid rails extending longitudinally along the bottom thereof, and the stabilizer frame likewise has skid rails which lie substantially in the same plane with the main frame skid rails when the apparatus is deployed, so that the apparatus may be dragged from one position to another by a single person. When the apparatus is folded, it is sufficiently compact and light in weight that it may be lifted by two men for stacking on a truck for transportation.

The main frame preferably has upper longitudinal rails generally parallel to the main frame skid rails, upright members connecting the main frame skid rails and the upper longitudinal rails at least at the forward and rear ends of the main frame, and lower cross-bars extending transversely to and interconnecting the main frame skid rails.

The stabilizer frame preferably is of a length approximately equal to the length of the main frame skid rails, and has a plurality of cross-bars interconnecting the stabilizer skid rails, and at least one upright member extending upwardly from each stabilizer skid rail at a forward end thereof. Each stabilizer frame upright member is pivotably connected to a respective upright member at the rear end of the main frame.

The apparatus preferably has target supporting means mounted within the main frame. The target supporting means includes a crankshaft rotatably mounted on the main frame and having a longitudinal axis transverse to the main frame skid rails. A drive assembly is operatively connected to rotate the crankshaft about a longitudinal axis thereof. The planar target member is connected to the crankshaft by suitable connecting means, and the drive arrangement is operatively connected to a control circuit or the like for rotating the crankshaft between a "target up" position in which the target is upright for shooting and a "target down" position in which the target is substantially horizontal.

Further objects, advantages and features of the present invention will be described further below with reference to the drawings.

THE PREFERRED EMBODIMENTS

Figure 1:
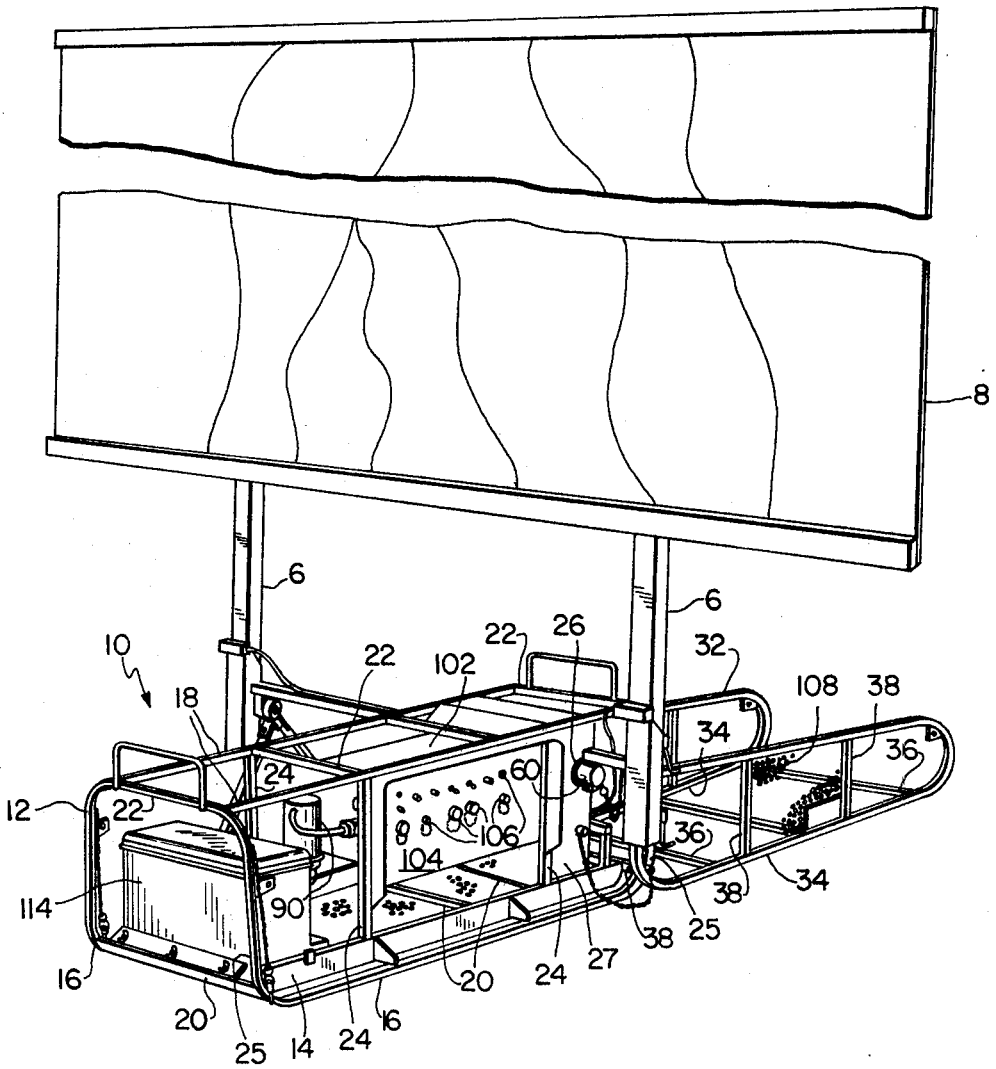
FIG. 1 shows in perspective view a single target apparatus with a planar target mounted thereon, deployed and ready for target practice.

FIG. 1 shows in perspective view a target apparatus 10 in accordance with the present invention. The target apparatus is deployed and has a target 8 mounted thereon. Planar target 8 may comprise a sheet of plywood or the like, suitably affixed to wooden target support arms 6 by suitable means such as nails.

The target support apparatus 10 has a generally box-like main frame 12 constructed of tubular members. The main frame has longitudinal support beams 14, longitudinal skid rails outboard of and slightly below the longitudinal support beams 14, and upper longitudinal rails 18. Lower cross-bars 20 interconnect the longitudinal support beams 14 and skid rails 16 as shown. Upper cross-bars 22 interconnect the upper rails 18, and uprights 24, 25 connect the skid rails 16 to the longitudinal support beams 14. The structural members of the main frame are preferably of metal tubing, such as square metal tubing, formed and welded to produce a robust and rigid structure. Toward the rear of the frame is provided an upright plate 27 at each side thereof, each plate 27 having a bearing block 26 in which is journaled a crankshaft 60 having a longitudinal axis transverse to the skid rails 16. As will be seen from FIG. 3, described further below, plate 27 is bolted to brackets 28 which are in turn welded to longitudinal support beams 14. Also as shown in FIG. 3, a bracket 30 is provided toward the forward end of the main frame for attaching a linear actuator, as will be described further below.

Referring again to FIG. 1, the target support apparatus 10 further comprises a stabilizer frame 32 constructed of skid rails 34, stabilizer crossbars 36, and upright members 38. Preferably, each side of the stabilizer frame is formed of a continuous lenght of metal tubing, such as square tubing, bent and welded to form a closed loop; the forwardmost upright members 38 of the stabilizer frame are thus integrally formed with the respective skid rails 34 and are somewhat curved.

Figure 2:
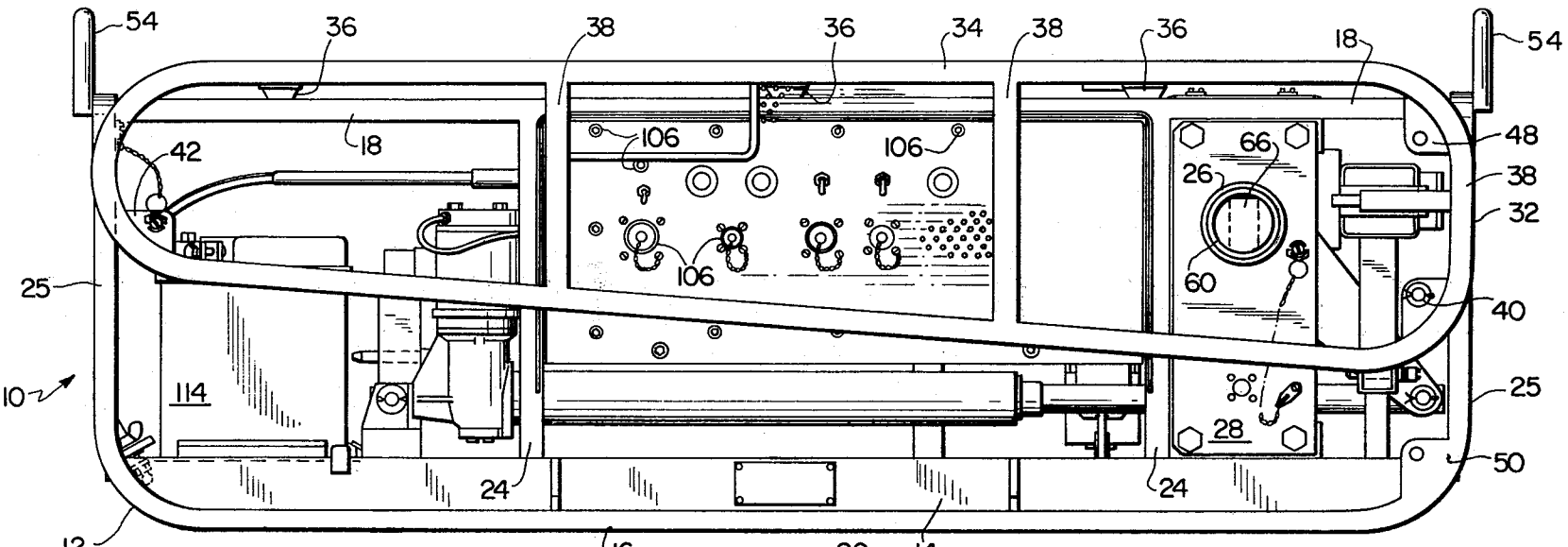
FIG. 2 shows a right side elevational view of the target support apparatus, folded and ready for storage or transportation.
Figure 3:
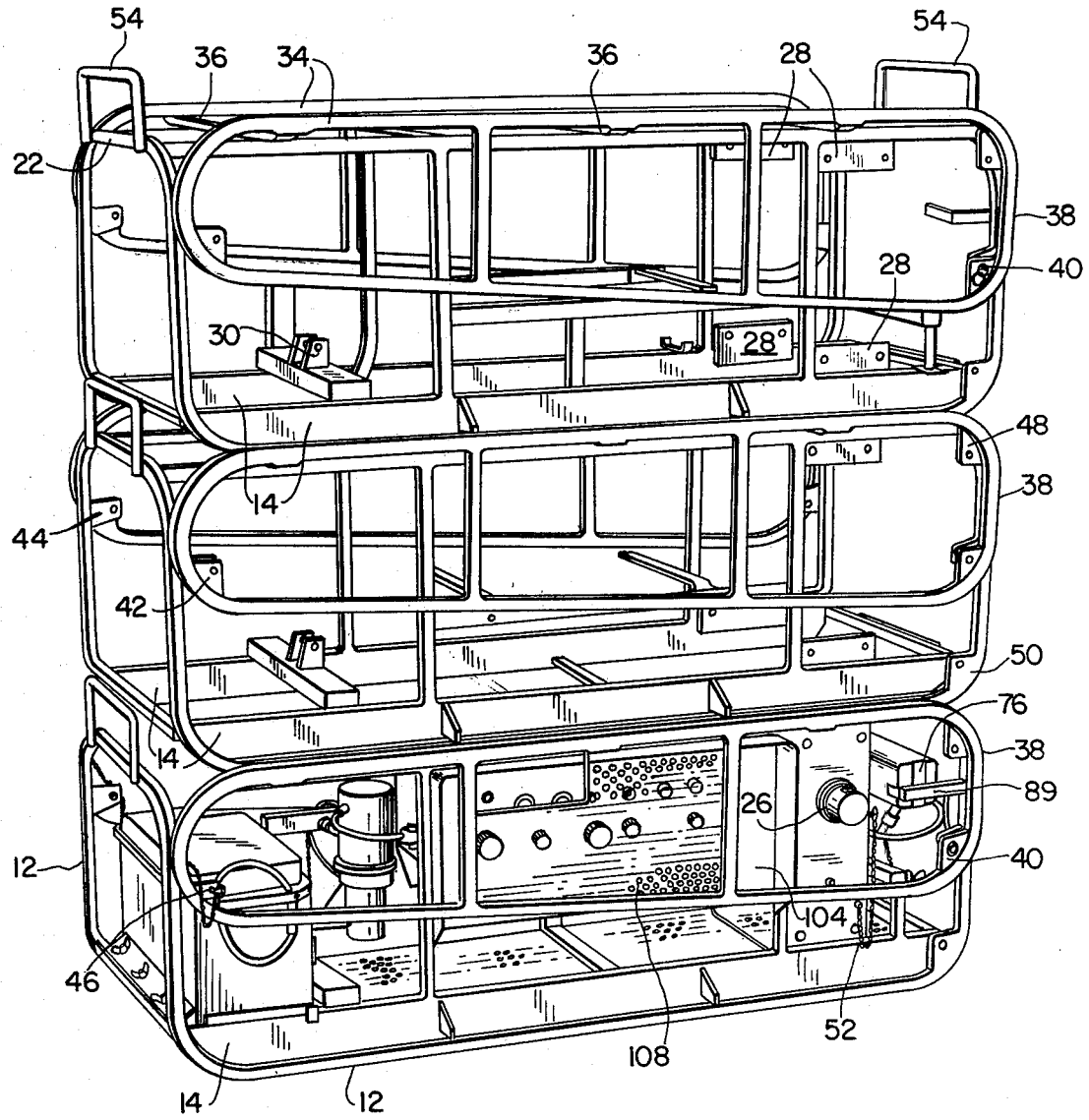
FIG. 3 shows in perspective view three stacked target support frameworks in accordance with the invention.

As can best be seen from FIGS. 2 and 3, the rearmost uprights 25 of main frame 10 and the forwardmost upright 38 of stabilizer frame 32 (that is, the stabilizer frame upright which is forwardmost when the target is deployed as in FIG. 1) are provided with bored ears which are connected by a pivot 40 at each side of the apparatus, as shown.

It can thus be seen that the stabilizer frame can be rotated upwardly about pivots 40 from the deployed position of FIG. 1 to the folded position of FIGS. 2 and 3. Since the overall length of the stabilizer frame is approximately equal to that of the main frame and the stabilizer skid rails and uprights are spaced apart at a distance somewhat greater than the width of the main frame, it can be seen that the folded framework of FIGS. 2 and 3 has exterior dimensions which are only slightly larger than the dimensions of the main frame itself.

Also as shown in FIGS. 2 and 3, the rearwardmost end of the stablizer frame 32 (when the apparatus is deployed as in FIG. 1) and the forwardmost portion of the main frame are provided with respective bored ears 42, 44; a lock pin 46 may thus be inserted through the coaligned bores of ears 42, 44 to lock the stabilizer frame in the folded position.

When the apparatus is deployed as shown in FIG. 1, bores provided in ears 48, 50 on the stabilizer frame and main frame are coaligned so that a lock pin 52 may be inserted therein to retain the stabilizer frame in the deployed position of FIG. 1.

FIG. 3 shows three target apparatuses in accordance with the invention stacked for storage or transport. As can be seen, stabilizer cross-bars 36 are welded to stabilizer skid rails 34 such that the skid rails 34 extend upwardly when the apparatus is folded. Further, the upper cross-bar 22 at each end of the main frame is provided with an upwardly-extending carrying handle or loop 54. When the folded target support mechanisms are stacked as shown in FIG. 3, the main frame skid rails 16 and lower crossbars 20 nest within the area defined by the stabilizer frame skid rails 34 and the carrying handles 54 of the apparatus situated directly below, so that the upper apparatus is securely retained against lateral movement relative to the lower apparatus. Preferably, the relative dimensions are established such that the upper target mechanism will not jostle about during transport, but such that the folded mechanisms are easily stacked and unstacked without binding. If desired, suitable locking means can be provided for fastening the stacked mechanisms together to prevent the mechanisms from bouncing relative to one another during transport over rough terrain.

Figure 4:
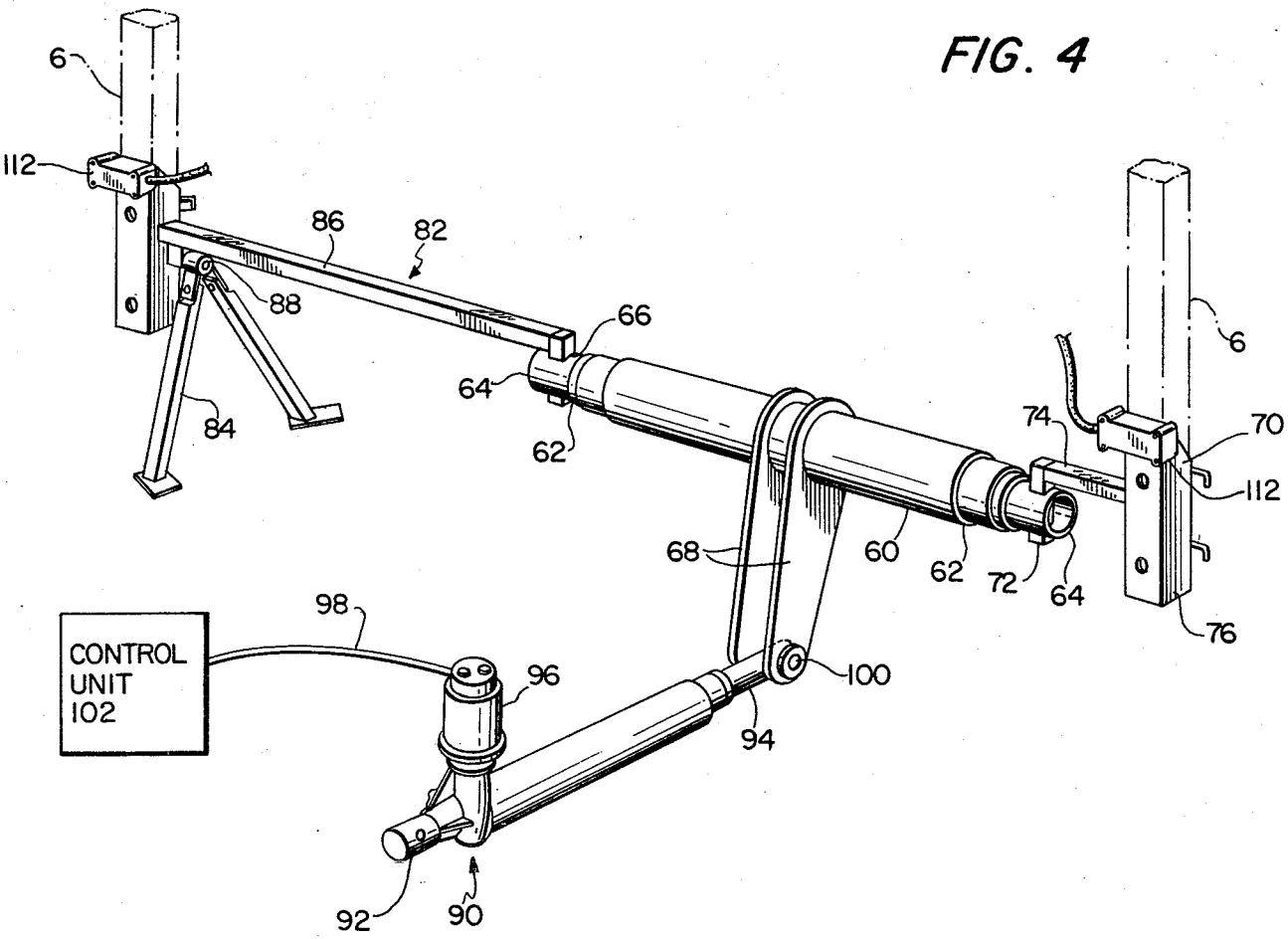
FIG. 4 shows in perspective view the target actuating mechanism.

Crankshaft 60 is more clearly shown in FIG. 4, as is additional structure for supporting and moving the target from an upright to a horizontal position. Crankshaft 60 has varying surfaces 62 which are journaled in bearings 26 of bearing bracket plate 28. End portions 64 of crankshaft 60 extend outboard of bracket plate 28, and are provided with transverse square bores 66. Welded or otherwise affixed to crankshaft 60 is a set of crank arms 68 provided with bores at their outermost ends.

Figure 5:
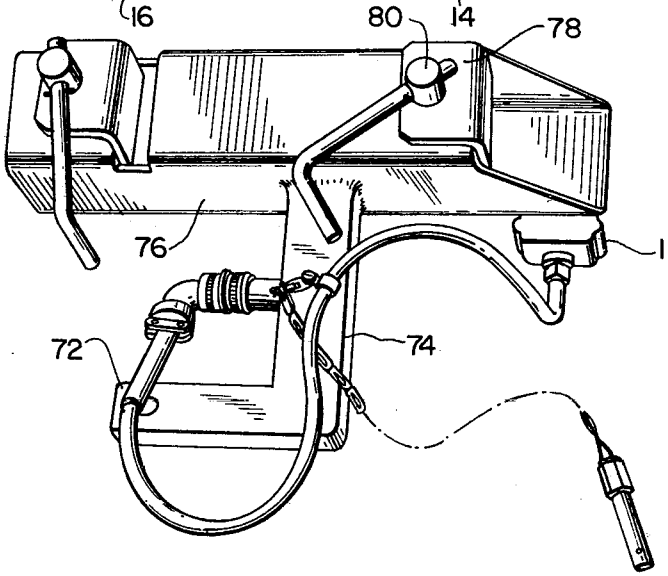
FIG. 5 shows a rear view of a target clamping arrangement in accordance with the invention.

A "short" target clamp assembly 70 is shown at the right side of FIG. 4 and in rear view in FIG. 5. The assembly comprises a square pin 72 adapted to fit in square bore 66 of crankshaft 60, a spacer rod 74 welded to pin 72, a square hollow tube 76 welded to spacer rod 74, and clamps 78 and turnscrews 80 for clamping a target support leg in the square hollow tube. Spacer rod 74 is of sufficient length that square tube 76 lies outboard of the main frame 12 when the target apparatus is deployed for use. It will be understood that any suitable clamping means other than clamps 78 and turnscrews 80 may be used for securing the target support leg in the hollow tube 76.

At the left side of FIG. 4 is shown a "long" target clamp assembly 82, which is substantially the same as "short" target clamp assembly 70. However, assembly 82 has a support leg member 84 with base plates which rest on the ground and with a pivotable connection 88 to the outboard end of a long spacer rod 86. The pivot axis of connection 88 is coaligned with the rotational axis of crankshaft 60.

If a narrow target is to be used (such as a target representing a head-on view of a jeep), the apparatus may be outfitted with two of the "short" target clamp assemblies 70. If a somewhat wider target is to be used, one short target clamp assembly 70 and one long target clamp assembly 82 may be used as shown in FIG. 4; it will also be seen that two "long " target clamp assemblies 82 may be employed if the target is substantially wider, such as a target representing a broadside view of a tank.

Pin 72 of the target clamp assembly may be provided with a transverse bore (not shown) for receiving a member which retains pin 72 in square bore 64 of crankshaft 60. The target clamp assemblies 70, 82 are readily disengageable from the crankshaft 60 and may be secured within main frame 12 by means of brackets 89 and/or straps (not shown) for storage.

Also shown in FIG. 4 is an electrically controllable linear actuator 90 which serves to rotate crankshaft 60. Linear actuator 90 has a rear pin 92 which connects to bracket 30 (FIG. 3) of main frame 12, and an extendable and retractable shaft 94. Shaft 94 may be operated by a suitable device 96 which is connected to a control circuit (described below) by a cable 98. The linear actuator 90 preferably has a cylinder coupled to a piston connected to shaft 94, and is hydraulically or pnuematically operated. Alternatively, linear actuator 90 may have a motordriven worm gear coupled to a threaded portion of shaft 94. Those of skill in the art will readily recognize a number of suitable arrangements for implementing linear actuator 90.

It is merely necessary that shaft 94 be controllably extendable and retractable so as to rotate crank 60 and thereby cause target support legs 6 and target 8 to pivot between upright and horizontal positions.

Linear actuator 90 is coupled to a suitable control unit 102 which is provided with a control panel 104 having manually-operable controls 106. The control unit may be, for example, of the type disclosed in U.S. Pat. No. 3,233,904 and/or U.S. Pat. No. 3,323,800, the disclosures of which are incorporated herein by reference. Control panel 104 may also be provided with connector plugs for attaching peripheral equipment such as a radio for reporting hit information to a central location, an alternate power source, a visual hit indicator (such as a lamp or horn), a gunfire simulator, or the like. The control unit may include circuitry for a number of additional operating and control functions; for example, it may provide for remote control of up, down and hostile fire functions, for raising the target in stages by remote control, for preselection of one of a number of time-periods of target exposure, for a choice of having the target fall when hit or remain in upright position, for a choice of automatically raising the target with a fixed delay after it is hit or raising the target only on command.

Impulse (hit detection) switches 112 are mounted on target clamp assemblies 70, 82 and are connected to control unit 102. Control unit 102 may further include circuitry which allows manual selection of impulse switch sensitivity for operation with small caliber or large caliber ammunition, respectively. Preferably, the target mechanism is self-contained and includes a battery 114 so that no external power supply is required during operation.

The target support apparatus is thus highly portable and is suitable for use in a number of training situations, including:

armor training
basic gunnery techniques
target identification and acquisition
tank-mounted coaxial and commander's machine gun practice
anti-tank ground warfare tracking techniques and training
continuation training and field firing practices
all arms combat training
infantry training
anti-tank weapon training armored personnel carrier and mounted infantry-carrying vehicle gunnery techniques
heavy machine gun and cannon shooting
all arms combat training
suppressive fire techniques The mechanism is easy to transport, quick to deploy and simple to maintain. It has been found that a complete unit when assembled may have a typical weight of about 150 pounds, and can be readily carried by two men. Further, the mechanism can be lifted at one end and dragged on its skids by one man, substantially reducing the number of personnel required to set up a range for training.

The folded mechanisms can be stacked as shown in FIG. 3, so that two men and a standard military truck can carry and deploy a typical range system of 21 target mechanisms in a single day. Because the target mechanism has a relatively low profile, little or no ground preparation is required at each site to provide protection for the mechanism from impact by projectiles.

The control unit may be provided with a number of built-in control and function options which render the mechanism extremely versatile. Such options include variations in automatic target exposure, the ability to expose the target in stages, and a choice of "fall when hit" or "hold up". The mechanism is particularly versatile when the control unit 102 is provided with means for varying "hit" detection sensitivity, so that the mechanism may be used with standard infantry ammunition (5.56 millimeter–9 millimeter) or large caliber ammunition (30 millimeter–120 millimeter).

For use with a NATO-size turret target (2.4 meters × 1.5 meters) constructed of 9 millimeter-thick plywood, it has been found that the target can be raised in approximately 8 seconds. It has also been found that when the framework is constructed with exterior dimensions of 1155 millimeters length, 455 millimeters height and 500 millimeters width, and is mounted with a NATO-size turret target, the apparatus can withstand wind loading of up to 45 kilometers per hour.

The linear actuator 90 is preferably provided with time-delayed stall protection and a mechanical clutch (not shown) which prevents electrical overload.

It has also been found that a target mechanism of this type can be deployed and tested by two men in less than 10 minutes. This provides a substantial saving of labor, time, and site preparation expense over previously-known types of full-size target mechanisms.

Those of skill in the art will recognize that a number of modifications can be made to the described embodiments within the spirit and scope of the present invention, which is limited only by the claims which follow.

What is claimed is:

1. A lightweight, portable apparatus which is foldable for storage, stackable when folded, and deployable to provide stable support for a planar target member for target shooting, comprising:

(a) a generally box-like main frame, including skid rails extending longitudinally along the bottom of the main frame, upper longitudinal rails generally parellel to the main frame skid rails, upright members connecting the main frame skid rails and the upper longitudinal rails at least at the forward and rear ends of the main frame, and lower cross-bars extending transversely to and interconnecting the main frame skid rails;

(b) a stabilizer frame, including a pair of stabilizer skid rails spaced apart a distance greater than the width of the main frame, and having a length approximately equal to the length of the main frame skid rails, a plurality of cross-bars interconnecting the stabilizer skid rails, and at least one upright member extending upwardly from each stabilizer skid rail at a forward end of the stabilizer frame;

(c) means pivotably connecting each stabilizer frame upright member to a respective upright member at the rear end of the main frame; and (d) means mounted to the main frame at a rear portion thereof for supporting the planar target, whereby when the apparatus is deployed for use the stabilizer frame extends rearwardly from the rear end of the main frame to provide a stable framework of approximately double the length of the main frame so as to prevent the apparatus from being tipped over as a result of impact or wind forces against the planar target, and whereby the apparatus may be folded for storage and transport by removing the planar target and pivoting the stabilizer frame upwardly about the connecting means until the stabilizer frame crossbars rest across the upper longutudinal rails of the main frame so that the folded apparatus is only slightly greater in dimension than the main frame.

2. The apparatus of claim 1, wherein the stabilizer skid rails extend upwardly of the main frame when the apparatus is folded and the main frame further includes a carrying handle extending above the upper longitudinal rails at each end of the main frame, whereby when the apparatus is folded the stabilizer skid rails and main frame carrying handles serve as restraining members for the main frame skid rails and lower cross-bars, respectively, of a second, folded target support apparatus of the same construction as said first-mentioned target support apparatus when said second folded target support apparatus is stacked on top of the first-mentioned support apparatus.

3. The apparatus of claim 1, further comprising means for locking the stabilizer frame in its deployed position, and means for locking the stabilizer frame in its folded position.

4. The apparatus of claim 1, wherein each stabilizer skid rail is integrally formed with the corresponding stabilizer upright member.

5. The apparatus of claim 4, wherein each stabilizer skid rail and corresponding upright member is formed of a continuous length of tubing, the tubing being bent and joined at its ends to form a closed planar loop defining the stabilizer skid rail and corresponding upright member.

6. The apparatus of claim 1, wherein the main frame ski rails are integrally formed of a single length of tubing bent to define uprights at each side of the forward and rear ends of the main frame, and upper cross-bars at each end of the main frame.

7. The apparatus of claim 1, wherein said target supporting means includes a crankshaft rotatably mounted on the main frame, having a longitudinal axis transverse to the main frame skid rails, drive means operatively connected to rotate the crankshaft about a longitudinal axis of the crankshaft, means connected to said crankshaft for attaching a planar target member to the crankshaft, and means operatively connected for controlling the drive means to rotate the crankshaft between a "target up" position in which the target is upright and a "target down" position in which the target is substantially horizontal.

8. The apparatus of claim 7, wherein the crankshaft includes an arm extending transversely to the longitudinal axis of the crankshaft, and wherein the drive means comprises a linear actuator connected at one end to the main frame and at a second end to the crankshaft arm, the linear actuator being extendable and retractable in length for rotating the crankshaft about its axis to move the target between the "target up" and "target down" positions.

9. The apparatus of claim 8, wherein the linear actuator comprises a fluid-operated piston-cylinder arrangement, and the drive means includes a controllable source of pressurized fluid for the linear actuator.

10. The apparatus of claim 7 wherein said target supporting means is mounted within the generally box-like main frame, the main frame further including a protective plate extending between the main frame skid rails.

11. The apparatus of claim 10, wherein said controlling means includes manually operable controls mounted on a control panel within said main frame, the controls being accessible when the apparatus is deployed, the stabilizer frame further including a protective plate which covers the controls when the apparatus is folded.

12. The apparatus of claim 8, wherein the linear actuator comprises a motor-driven worm gear and threaded rod arrangement, and the drive means includes a controllable motor for driving the worm gear.

13. The apparatus of claim 8, wherein the crankshaft is provided near each of its ends with a transverse bore, and wherein the target securing means comprises, at each end of the crankshaft, a target clamping arrangement having a pin dimensioned to engage the transverse bore of the crankshaft, a hollow tube connected to the pin for receiving a target support arm affixed to the target, and means for securely clamping a target support arm within the hollow tube.

14. The apparatus of claim 13, wherein the target securing means further includes a spacer rod connecting the pin to the hollow tube, whereby the hollow tube is spaced at a distance outboard of the main frame.

15. The apparatus of claim 14, further comprising a support member pivotably mounted on an outboard end of the spacer rod adjacent the hollow tube and having a pivot axis aligned with the crankshaft axis, for supporting the hollow tube.

16. The apparatus of claim 13 including control circuit means comprising a hit detection switch mounted on the target securing means and coupled for providing a signal to the controlling means, the controlling means being responsive to said signal for operating the drive means to rotate said crankshaft from the "target up" to the "target down" position.

* * * * *